US006206804B1

(12) United States Patent
Maresh

(10) Patent No.: US 6,206,804 B1
(45) **Date of Patent: *Mar. 27, 2001**

(54) EXERCISE METHODS AND APPARATUS

(76) Inventor: Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

This patent is subject to a terminal disclaimer.

(21) Appl. No.: 09/054,643

(22) Filed: Apr. 3, 1998

Related U.S. Application Data

(63) Continuation-in-part of application No. 08/503,931, filed on Jul. 19, 1995, now Pat. No. 5,735,774.

(60) Provisional application No. 60/044,957, filed on Apr. 26, 1997, provisional application No. 60/044,959, filed on Apr. 26, 1997, and provisional application No. 60/044,956, filed on Apr. 26, 1997.

(51) Int. Cl.[7] ..... A63B 23/10; A63B 22/00
(52) U.S. Cl. ..... 482/52; 482/51
(58) Field of Search ..... 482/51–53, 57, 482/70, 79, 80, 63

(56) References Cited

U.S. PATENT DOCUMENTS 5,735,774 * 4/1998 Maresh ..... 482/57
5,935,046 * 8/1999 Maresh ..... 482/57

* cited by examiner

*Primary Examiner*—Stephen R. Crow

(57) ABSTRACT

An exercise apparatus has a crank and a degree of freedom disposed between a force receiving member and a frame. The resulting linkage allows the force receiving member to move through a generally elliptical path of motion.

18 Claims, 13 Drawing Sheets

EXERCISE METHODS AND APPARATUS

CROSS-REFERENCE TO RELATED APPLICATION

This application is a continuation-in-part of U.S. patent application Ser. No. 08/503,931, which was filed on Jul. 19, 1995, and is now U.S. Pat. No. 5,735,774; and it also discloses subject matter shown and described in U.S. Provisional Application Ser. Nos. 60/044,957, 60/044,959, and 60/044,956, all filed on Apr. 26, 1997.

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical.

SUMMARY OF THE INVENTION

In one respect, the present invention may be seen to provide a novel linkage assembly and corresponding exercise apparatus suitable for encouraging generally elliptical exercise motion. The linkage assembly allows foot supports to travel along elliptical paths which may be altered by adjustable components at the operator's discretion.

In a preferred embodiment, a rocker link and a crank are interconnected in series between a frame and each foot support. More specifically, the rocker link is rotatably interconnected between the frame and the crank; and the crank is rotatably interconnected between the rocker link and the foot support. Rotation of the cranks causes the foot supports to move back and forth in cyclical fashion, and the pivotal nature of the rocker links allows the foot supports to be moved a discretionary distance in a second, perpendicular direction. Many advantages and improvements of the present invention may become apparent from the more detailed description that follows.

BRIEF DESCRIPTION OF THE DRAWING

With reference to the Figures of the Drawing, wherein like numerals represent like parts and assemblies throughout the several views.

DESCRIPTION OF THE DEPICTED EMBODIMENT

Figure 1:
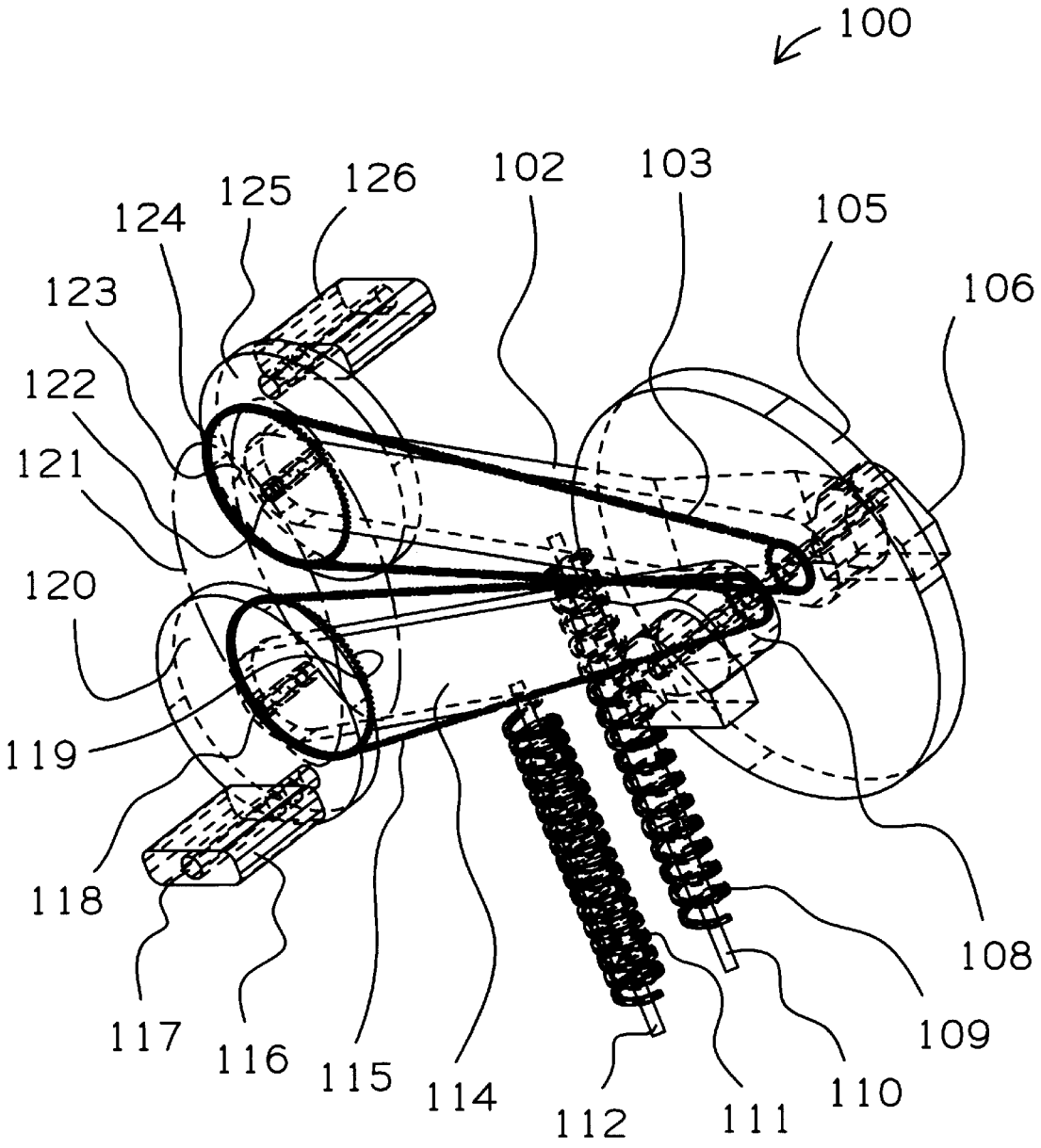
FIG. 1 is a perspective view of an exercise apparatus constructed according to the principles of the present invention.
Figure 2:
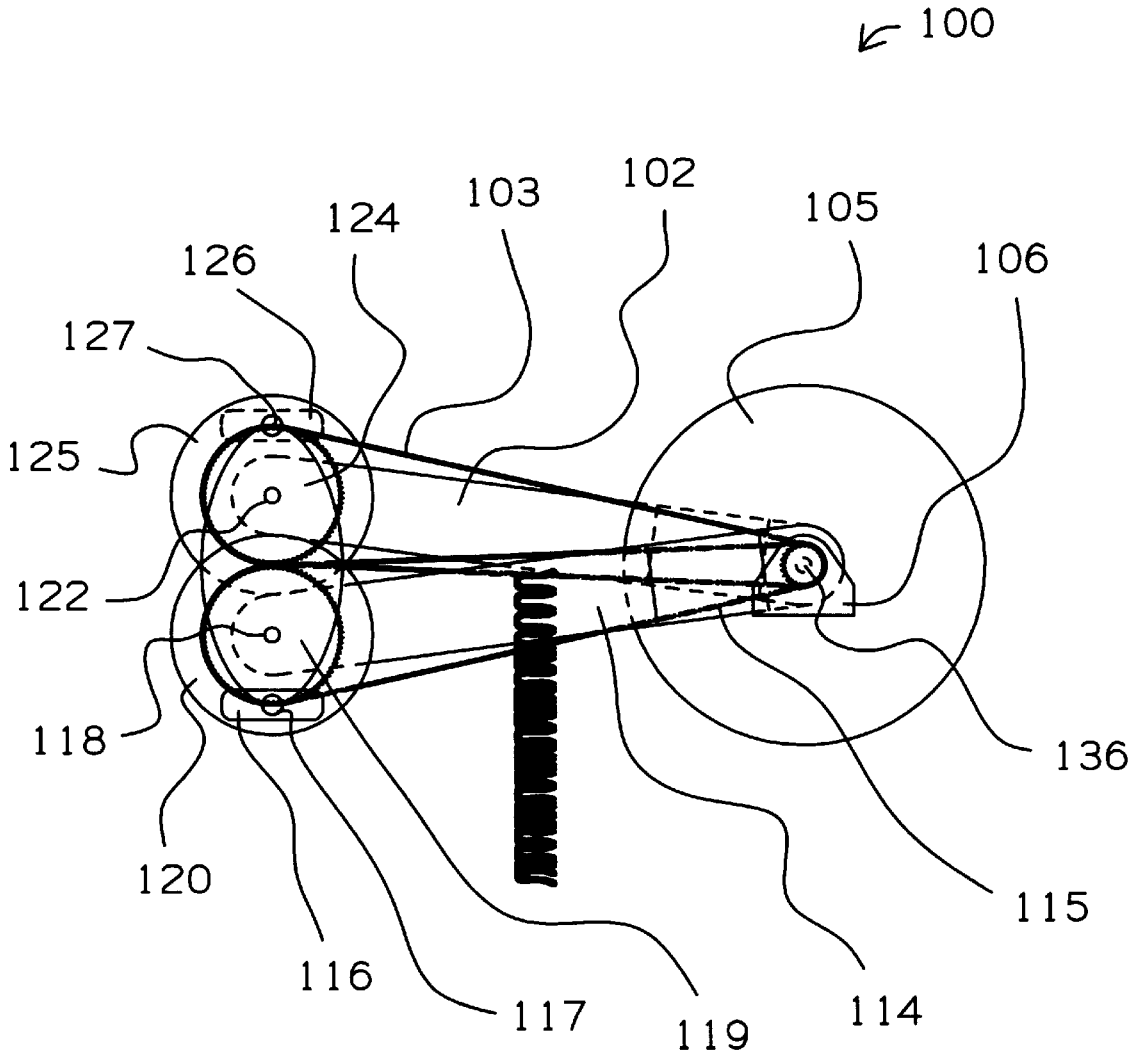
FIG. 2 is a side view of the exercise apparatus of FIG. 1.
Figure 3:
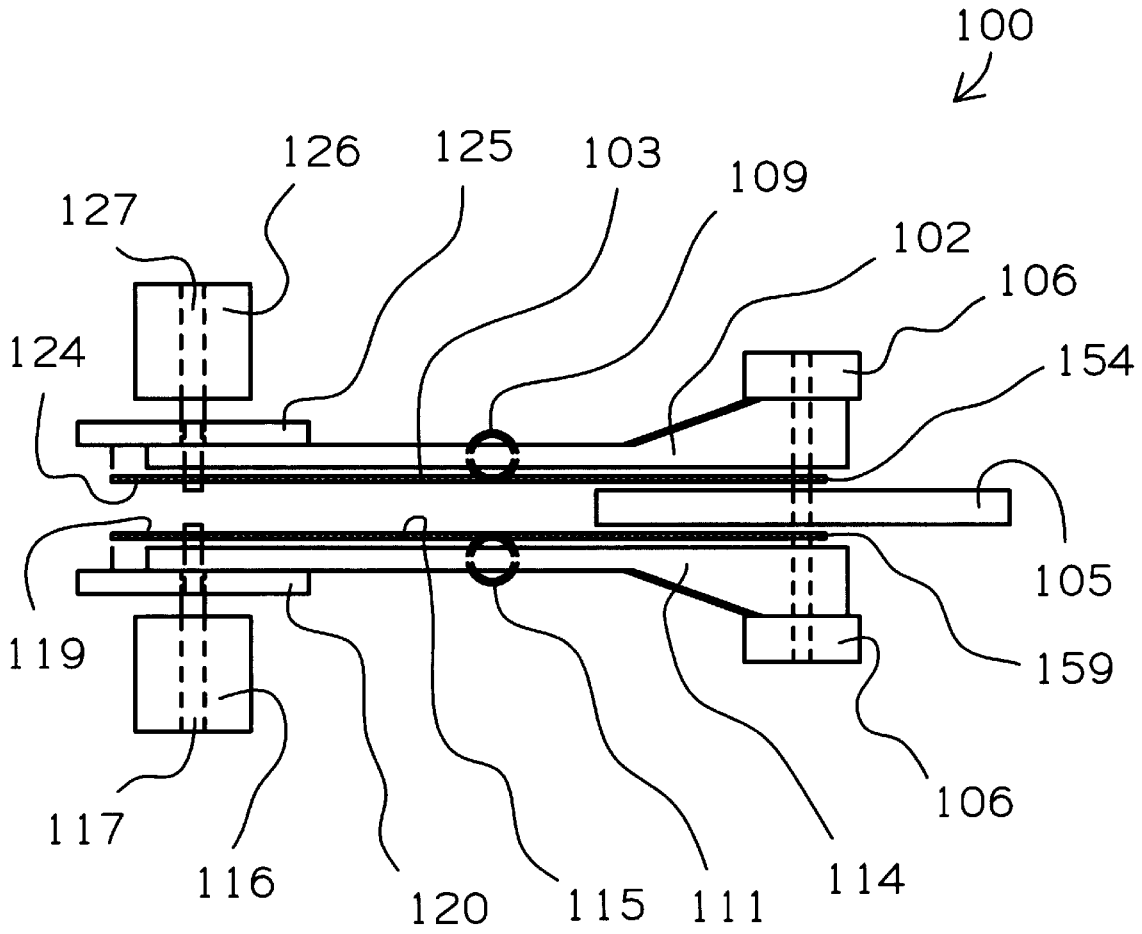
FIG. 3 is a top view of the exercise apparatus of FIG. 1.
Figure 4:
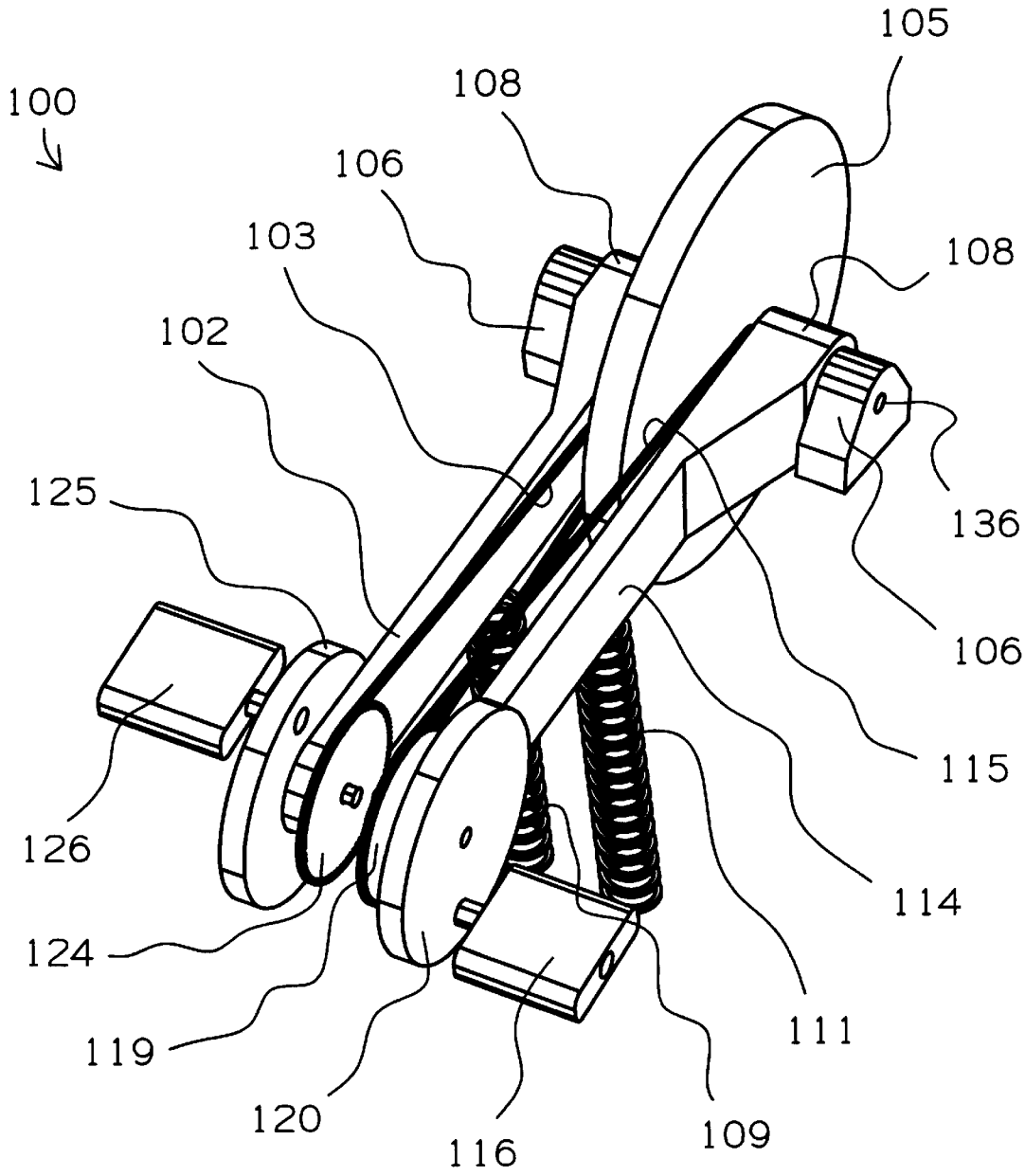
FIG. 4 is a second perspective view of the exercise apparatus of FIG. 1.

A first exercise apparatus constructed according to the principles of the present invention is designated as 100 in FIGS. 1–4. The apparatus will be described with reference to a seated user, although it may be modified for use by a standing user, as well. The majority of the exercise apparatus frame is not shown, but bearing assemblies designated as 106 in FIG. 1 are a suitable point of reference for describing the apparatus 100 relative to a frame.

The frame may be configured to support a user in a seated position generally above a flywheel 105 which is rotatably mounted to the frame by means of the bearing assemblies 106 and a flywheel shaft 136. The seated user may then position his feet on respective platforms 126 and 116. In this application, the foot platforms 126 and 116 are movable through elliptical paths of motion 123 and 121, respectively, having major axes extending generally parallel to the user's lower legs and generally perpendicular to the user's upper legs.

Each foot platform 126 and 116 is rotatably connected to a respective crank 125 or 120 by means of a respective pedal axle 127 or 117. The cranks 125 and 120 are shown as solid discs, but simple or crank arms could be used instead. Crank drive members 124 and 119 are connected to respective cranks 125 and 120 by means of crank shafts 122 and 118. In particular, both the crank drive member 124 and the crank 125 are keyed to the shaft 122, and both the crank drive member 119 and the crank 120 are keyed to the shaft 118. The crank drive members 124 and 119 are depicted as roller chain sprockets, but other arrangements, including V-belt pulleys, may be used without departing from the scope of the present invention.

Support members or beams 102 and 114 have first, reinforced ends 108 which are pivotally mounted to the frame by means of the flywheel shaft. The right crank shaft 122 is rotatably mounted on the first support member or beam 102, proximate an opposite, distal end thereof. The first beam 102 occupies the upwardly disposed position shown in FIG. 1 in the absence of force or torque applied against the right foot pedal 126. The left crank shaft 118 is rotatably mounted on a second support member or beam 114, proximate a distal end thereof. The beams 114 and 102 are pivotal to positions where the crank shafts 122 and 118 are axially aligned with one another.

Relatively smaller sprockets 154 and 159 are keyed to the flywheel shaft between respective beams 114 and 102 and opposite sides of the flywheel 105. The sprockets 154 and 159 are connected to respective crank drive members 124 and 119 by means of respective chains 103 and 115. The chains 103 and 115 link rotation of the cranks 125 and 120 to "stepped up" rotation of the flywheel 105 and cause synchronous rotation of the cranks 125 and 120.

First and second helical coil springs 109 and 111 are maintained in compression between the frame and respective beams 102 and 114. Also, first and second dampers 110 and 112 are disposed between the frame and respective beams 102 and 114 to dampen movement of the latter relative to the former. The springs 109 and 111 and the dampers 110 and 112 act upon a central portion of a respective beam 102 or 114. Those skilled in the art will recognize that a single resistance device could be applied to both beams 102 and 114 by means of a pivoting yoke, for example. Such a yoke may be used with a mechanical spring or with a constant force, pressure actuated rod and cylinder supplied with fluid pressure.

Figure 5:
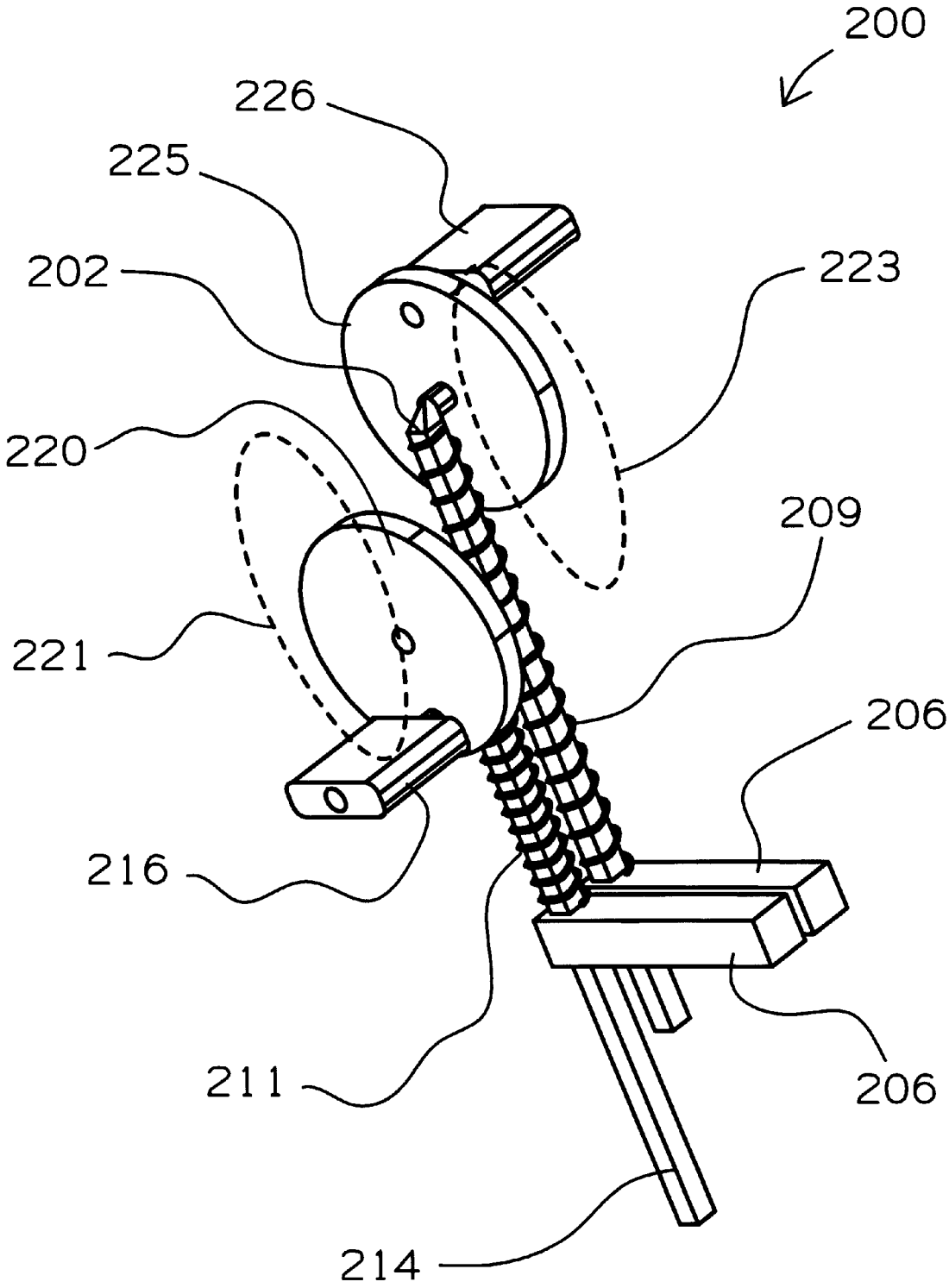
FIG. 5 is a perspective view of a second exercise apparatus constructed according to the principles of the present invention.

A second exercise apparatus constructed according to the principles of the present invention is designated as 200 in FIG. 5. First and second beams or slider links 202 and 214 are connected to frame members 206 and move linearly relative thereto. First and second cranks 225 and 220 are connected to distal ends of respective links 202 and 214 and rotate relative thereto. Springs 209 and 211 are disposed on respective links 202 and 214 and serve to bias the cranks 225 and 220 away from the frame members 206 and/or resist movement of the cranks 225 and 220 toward the frame members 206.

Foot platforms or pedals 226 and 216 are connected to respective cranks 225 and 220 and rotate relative thereto, thereby defining pedal axes which are radially displaced from the respective crank axes. As with the previous embodiment 100, maximum displacement of the pedals 226 and 216 in a first direction, perpendicular to the links 202 and 214, is determined by the diameter of the cranks 225 and 220, and maximum displacement of the pedals 226 and 216 in a second direction, parallel to the links 202 and 214, is determined by the amount of force a user exerts against the springs 209 and 211. One pair of any number of possible elliptical foot paths is designated as 223 and 221 in FIG. 5. Contrary to the previous embodiment 100, the cranks 225 and 220 are not synchronized.

Figure 6:
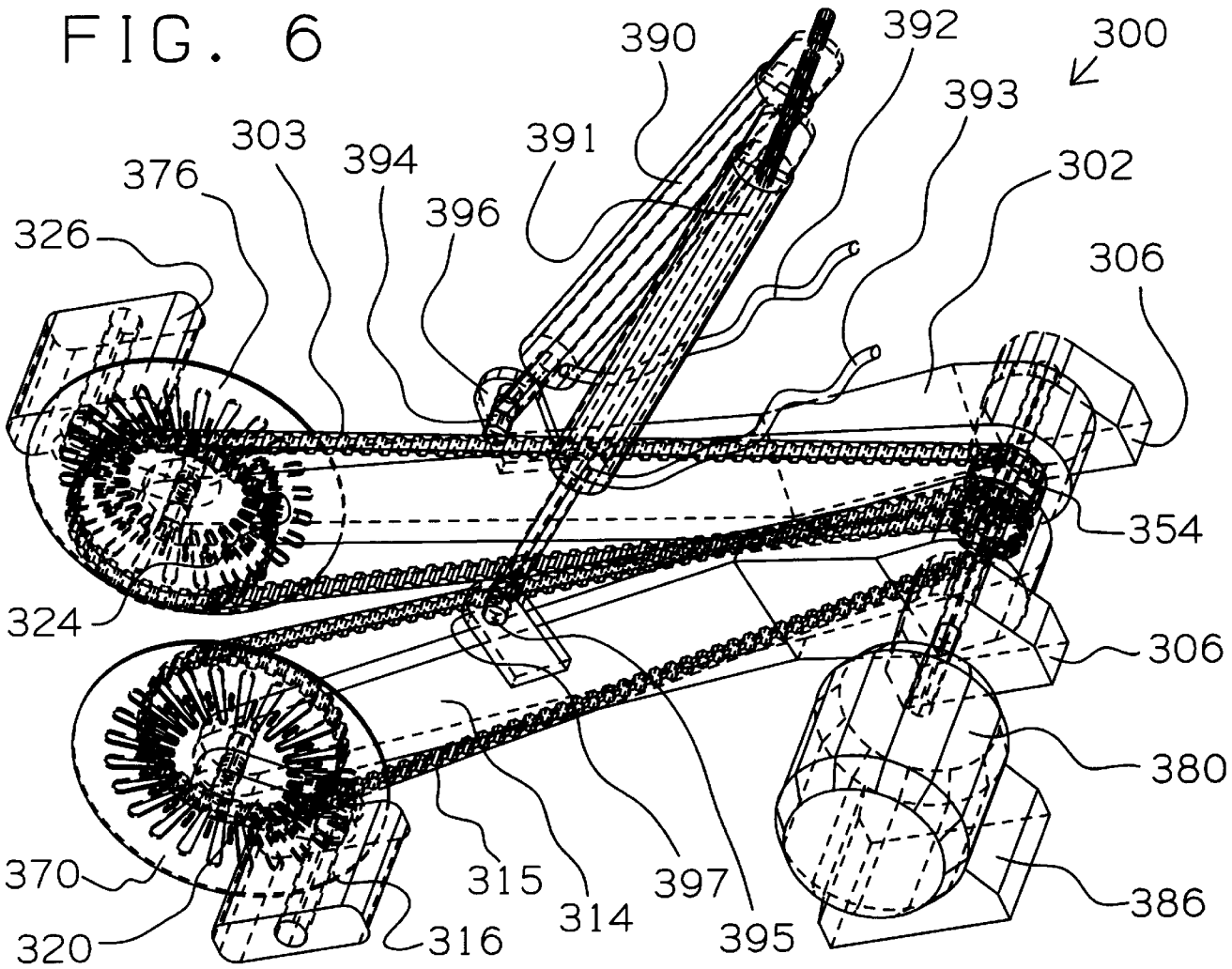
FIG. 6 is a perspective view of a third exercise apparatus constructed according to the principles of the present invention.

A third exercise apparatus constructed according to the principles of the present invention is designated as 300 in FIG. 6. This third embodiment 300 is similar in several respects to the first embodiment 100. First and second beams or rocker links 302 and 314 are connected to frame members 306 and pivot relative thereto. First and second cranks (one of which is designated as 320) are connected to distal ends of respective links 302 and 314 and rotate relative thereto. First and second foot platforms or pedals 326 and 316 are connected to respective cranks and rotate relative thereto, thereby defining pedal axes which are radially displaced from the respective crank axes.

First and second crank drive members or large diameter sprockets (one of which is designated as 324) are keyed to respective crank shafts. First and second discs 376 and 370 serve as shields between respective sprockets and pedals 326 and 316 to reduce the likelihood of interference between the operator and the exercise apparatus 300.

Relatively smaller sprockets (one of which is designated as 354) are keyed to a motor shaft and connected to respective crank drive members by means of respective timing belts 303 and 315. The motor shaft protrudes from a motor 380 which is secured to the frame by means of a mounting assembly 386. The motor shaft is also supported by bearing assemblies 306 on the frame, which are disposed on opposite sides of the beams 302 and 314. A freewheel clutch or slip clutch may be added to this arrangement, as desired.

The timing belts 303 and 315 link rotation of the motor shaft to rotation of the cranks and ensure synchronous rotation of the cranks. In FIG. 6, the first crank is forty-five degrees into a cycle, and the second crank 320 is two hundred and twenty-five degrees into a cycle.

Air springs 390 and 391 are disposed between the frame and respective links 302 and 314 and may be described as a means for resisting downward pivoting of the links 302 and 314 relative to the frame members 306. Hoses 392 and 393 supply constant air pressure to the cylinder ends of respective springs 390 and 391. Distal rod ends 394 and 395 of respective springs 390 and 391 are rotatably connected to trunnions 396 and 397 on respective beams 302 and 314.

Figure 7:
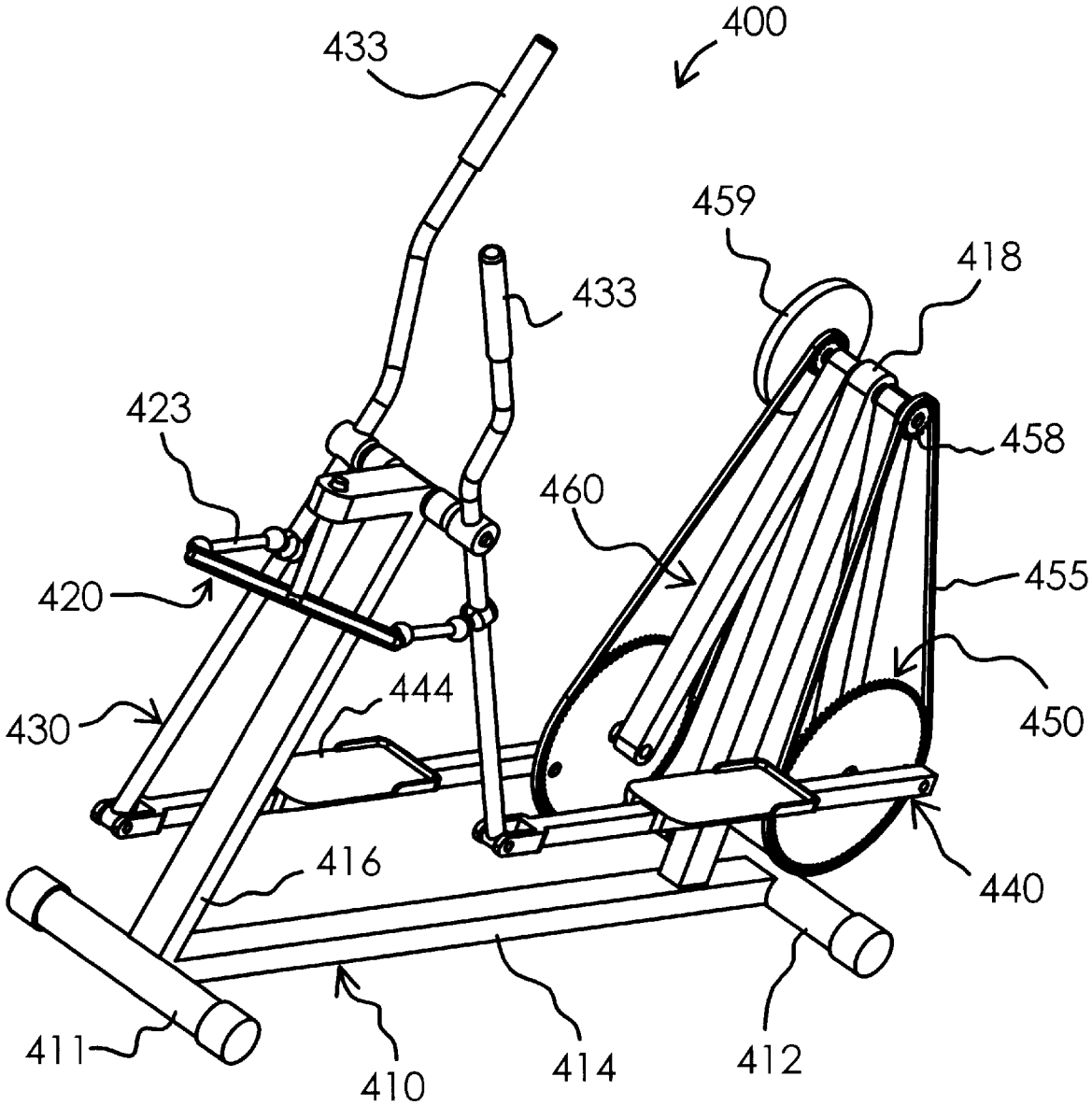
FIG. 7 is a perspective view of a fourth exercise apparatus constructed according to the principles of the present invention.
Figure 8:
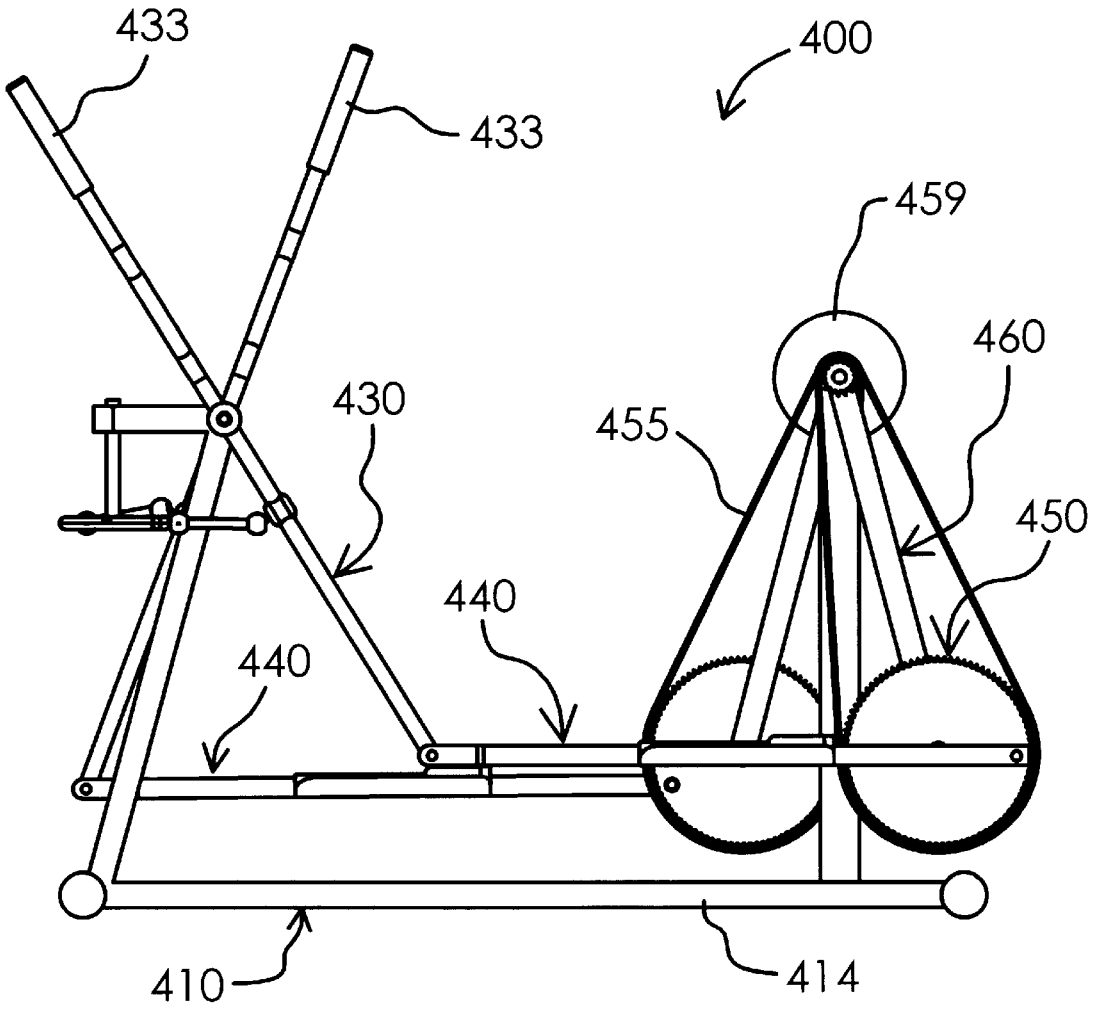
FIG. 8 is a side view of the exercise apparatus of FIG. 7.
Figure 9:
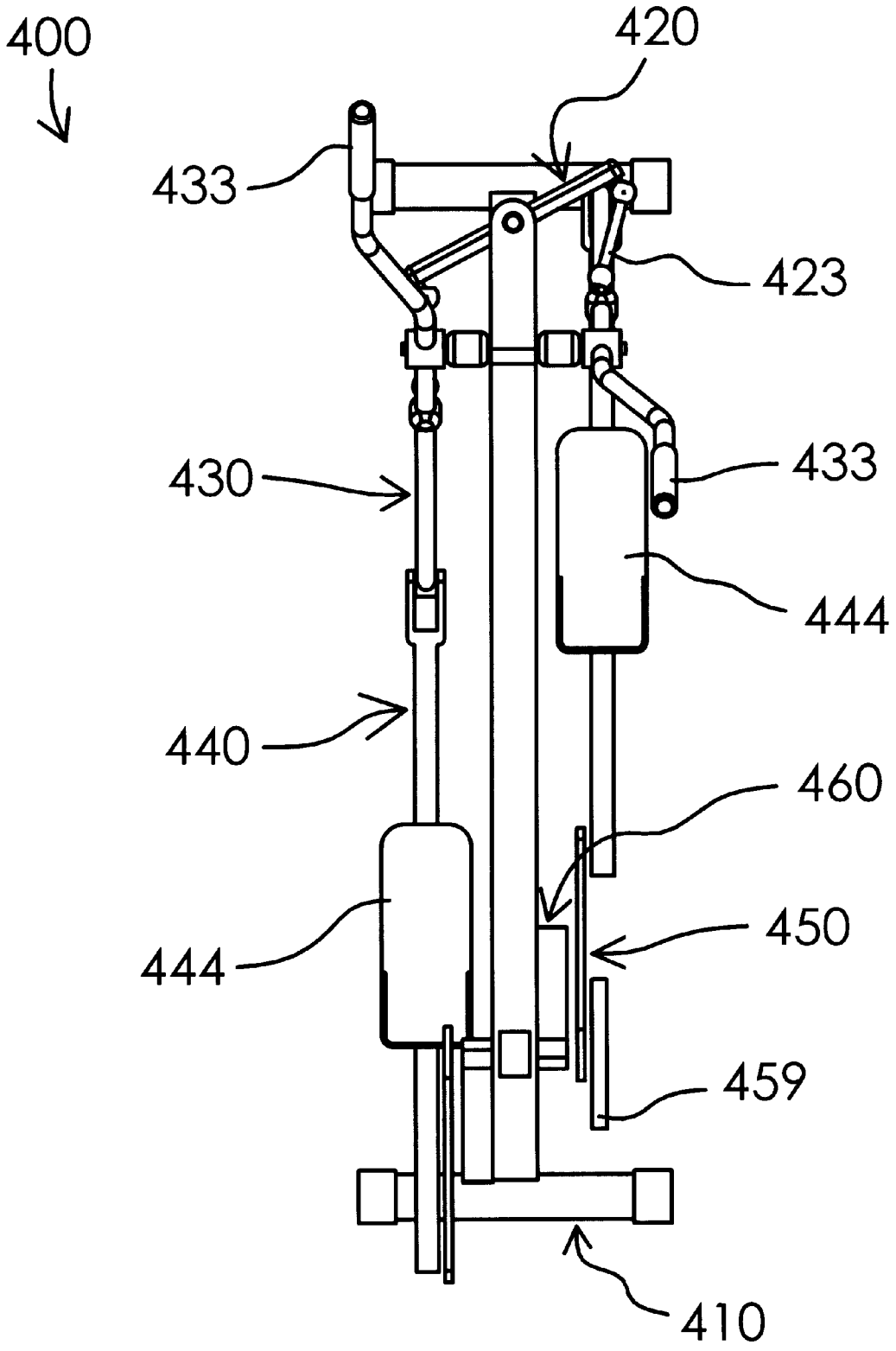
FIG. 9 is a top view of the exercise apparatus of FIG. 7.

A fourth exercise apparatus constructed according to the principles of the present invention is designated as 400 in FIGS. 7–9. The apparatus 400 generally includes a frame 410 and a linkage assembly movably mounted on the frame 410. Generally speaking, the linkage assembly encourages a force receiving member 440 to travel through an elliptical path of motion without constraining the force receiving member 440 to move through only one particular elliptical path of motion. The term "elliptical motion" is intended in a broad sense to describe a closed path of motion having a relatively longer first axis and a relatively shorter second axis (which extends perpendicular to the first axis).

The frame 410 includes a generally I-shaped base 414 designed to rest upon a floor surface; a forward stanchion 416, which extends upward from the base 414 proximate a forward end 411 of the frame 410; and a rearward stanchion 418, which extends upward from the base 414 proximate an opposite, rearward end 412 of the frame 410. The apparatus 400 is generally symmetrical about a vertical plane extending lengthwise through the base 414 (perpendicular to the transverse members at each end thereof), the only exceptions being a flywheel 459 and the relative orientation of certain parts of the linkage assembly on opposite sides of the plane of symmetry. Those skilled in the art will also recognize that the portions of the frame 410 which are intersected by the plane of symmetry exist individually and thus, do not have any "opposite side" counterparts. Moreover, although reference is made to forward or rearward portions of the apparatus 400, a person could exercise while facing toward either the front or the rear of the frame 410.

On each side of the apparatus 400, the linkage assembly generally includes a forward rocker link 430, a force receiving link 440, a crank 450, and a rear rocker link 460. On the embodiment 400, the crank 450 on the left side of the apparatus 400 is 180 degrees out of phase with the crank 450 on the right side of the apparatus 400, and the links on the left side move in opposite directions relative to their right side counterparts. However, like reference numerals are used to designate both the "right-hand" and "left-hand" parts on the apparatus 400, and in general, when reference is made to one or more parts on only one side of the apparatus, it is to be understood that corresponding part(s) are disposed on the opposite side of the apparatus 400.

On each side of the apparatus 400, an upper end of a rear rocker link 460 is rotatably mounted on the rear stanchion 418 via a common shaft. In particular, bearings are disposed between the rear rocker links 460 and the shaft to allow the former to freely rotate relative to the latter. Bearings are also disposed between the shaft and the rear stanchion 418 to allow the former to freely rotate relative to the latter. A sprocket 458 is keyed to each of the protruding ends of the shaft, on opposite sides of the stanchion 418 and the rear rocker links 460. A flywheel 459 is also keyed to the shaft to rotate together with the shaft and the sprockets 458. A conventional drag strap or other known resistance device may be connected to the flywheel 459 to provide resistance to rotation.

On each side of the apparatus 400, a crank 450 is rotatably mounted on a lower end of a respective rear rocker link 460. Each crank 450 has gear teeth disposed about its circumference and is connected to a respective sprocket 458 by means of a chain 455. The cranks 450 are significantly larger in diameter than the sprockets 458 and cooperate therewith to provide a stepped up flywheel arrangement. The common shaft extending between the sprockets 458 links rotation of the left crank 450 to rotation of the right crank 450.

On each side of the apparatus 400, a force receiving link 440 has a rear end rotatably connected to a respective crank 450 at a location radially displaced from the crank axis (defined between the crank 450 and the rear rocker link 460). A forward end of each force receiving link 440 is constrained to move in reciprocal fashion relative to the frame 410. An intermediate portion 444 of each force receiving link 440 is sized and configured to support a person's foot.

Each crank 450 cooperates with a respective rear rocker link 460 to define a crank and rocker combination which is connected, in series, between the frame 410 and a respective force receiving member 440. This portion of the linage assembly may also be described in terms of a first member (rear rocker link 460) which is mounted on the frame 410 and rotatable thereto about a first axis; a second member (crank 450) which is mounted on the first member and rotatable thereto about a second axis spaced radially apart from the first axis; and a force receiving member 440 which is mounted on the second member and rotatable thereto about a third axis spaced radially apart from the second axis (and the first axis).

On each side of the apparatus 400, the forward end of a force receiving member 440 is rotatably mounted on a lower end of a respective forward rocker link 430. An intermediate portion of each forward rocker link 430 is rotatably mounted to the forward stanchion 416. An upper end 433 of each forward rocker link 430 is sized and configured for grasping by a person standing on the foot supporting links 440.

The forward rocker links 430 are interconnected to move in dependent fashion in opposite directions relative to one another. In particular, a connector link 420 is mounted on the forward stanchion 416 and rotatable relative thereto about a vertical axis. A second, relatively lower intermediate portion of each forward rocker link 430 is connected to the connector link 420 by means of a universal link 423, which defines ball joints with both the connector link 420 and the forward rocker link 430.

Figure 10:
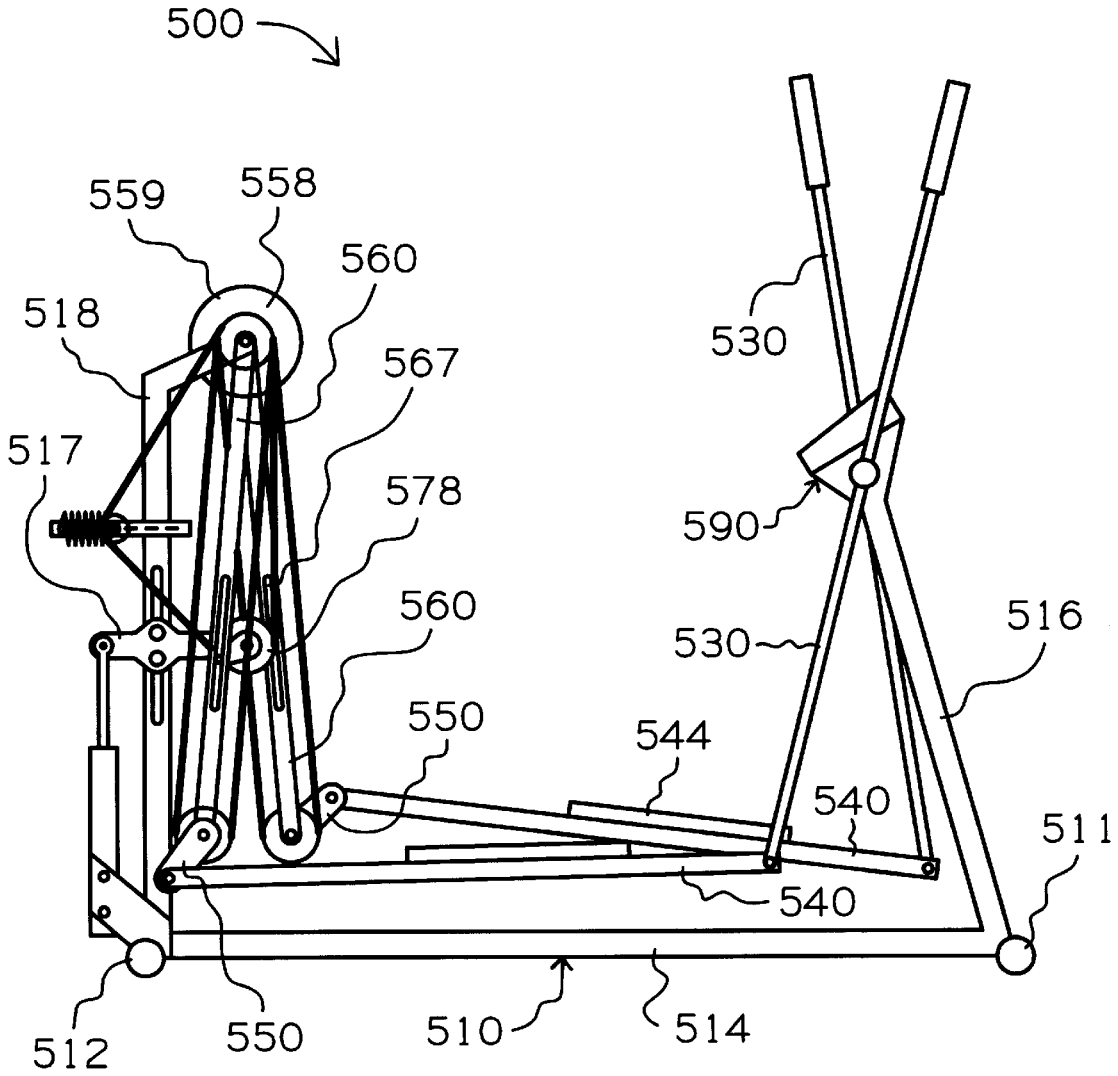
FIG. 10 is a side view of a fifth exercise apparatus constructed according to the principles of the present invention.

A fifth exercise apparatus constructed according to the principles of the present invention is designated as 500 in FIG. 10. The apparatus 500 generally includes a frame 510 and a linkage assembly movably mounted on the frame 510. Generally speaking, the linkage assembly encourages a force receiving member 540 to travel through an elliptical path of motion having a variable length.

The frame 510 includes a generally I-shaped base 514 designed to rest upon a floor surface; a forward stanchion 516, which extends upward from the base 514 proximate a forward end 511 of the frame 510; and a rearward stanchion 518, which extends upward from the base 514 proximate an opposite, rearward end 512 of the frame 510. The apparatus 500 is generally symmetrical about a vertical plane extending lengthwise through the base 514 (perpendicular to the transverse members at each end thereof), the only exceptions being certain parts which have no opposite side counterparts and the relative orientation of linkage assembly components on opposite sides of the plane of symmetry.

On each side of the apparatus 500, the linkage assembly generally includes a forward rocker link 530, a force receiving link 540, a crank 550, and a rear rocker link 560. On the embodiment 500, the crank 550 on the left side of the apparatus 500 is 180 degrees out of phase with the crank 550 on the right side of the apparatus 500, and the links on the left side move in opposite directions relative to their right side counterparts. However, like reference numerals are used to designate both the "right-hand" and "left-hand" parts on the apparatus 500, and in general, when reference is made to one or more parts on only one side of the apparatus, it is to be understood that corresponding part(s) are disposed on the opposite side of the apparatus 500.

On each side of the apparatus 500, an upper end of a rear rocker link 560 is rotatably mounted on the rear stanchion 518 via a common shaft. In particular, bearings are disposed between the rear rocker links 560 and the shaft to allow the former to freely rotate relative to the latter. Bearings are also disposed between the shaft and the rear stanchion 518 to allow the former to freely rotate relative to the latter. A sprocket 558 is keyed to each of the protruding ends of the shaft, on opposite sides of the stanchion 518 and the rear rocker links 560. A third sprocket 558 is keyed to an intermediate portion of the shaft, between the rear rocker links 560. A flywheel 559 is also keyed to the shaft to rotate together with the shaft and the sprockets 558. A conventional drag strap or other known resistance device may be connected to the flywheel 559 to provide resistance.

Figure 11:
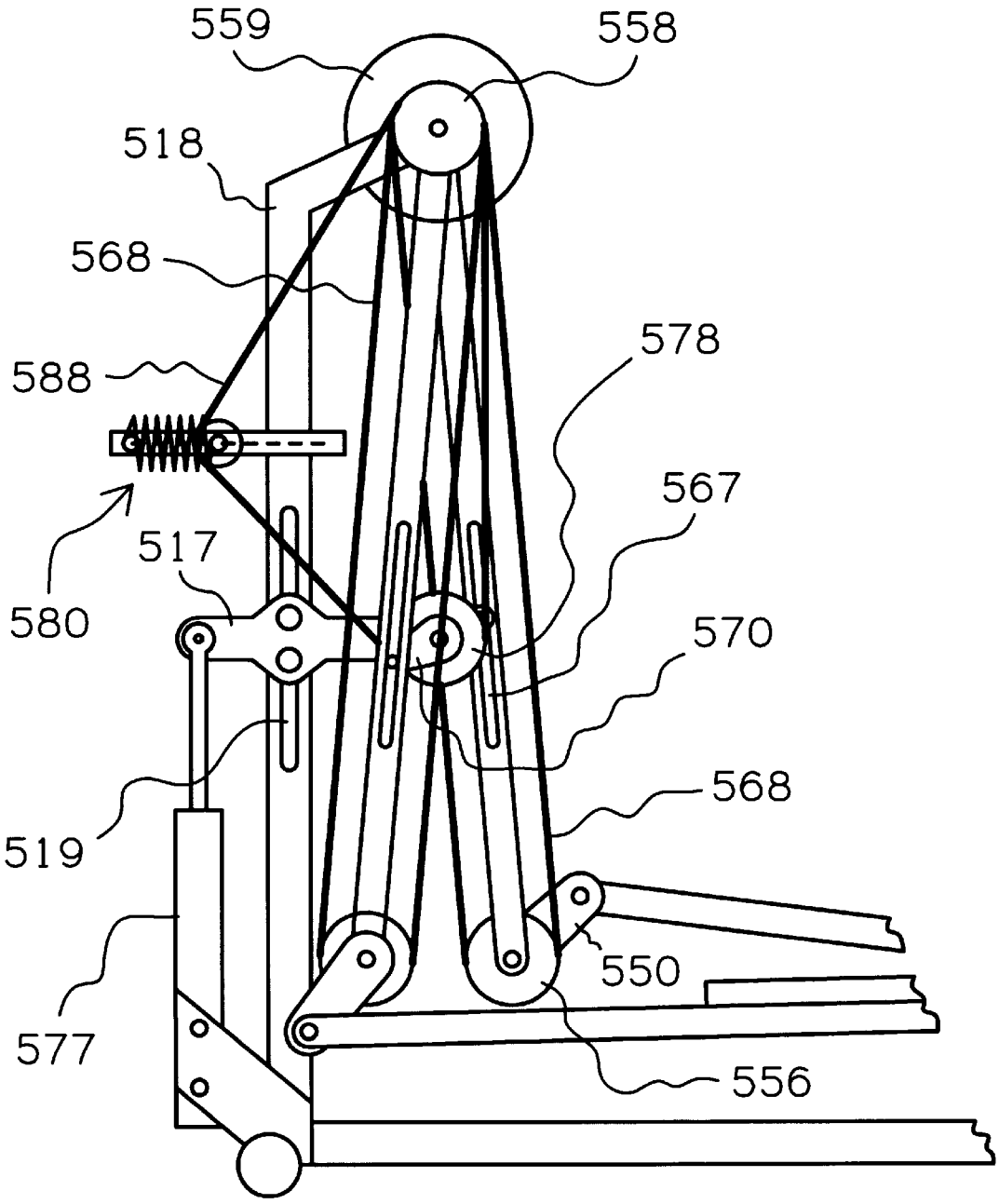
FIG. 11 is an enlarged side view of a rearward end of the exercise apparatus of FIG. 10.

With reference to FIG. 11, a guide is interconnected between the rear stanchion 518 and each of the rear rocker links 560. In particular, the guide is mounted on a frame member 517 which slides along a vertical slot 519 in the stanchion 518. A linear actuator 577 is interconnected between the frame member 517 and the stanchion 518 and is operable to maintain the former in any of several fixed positions relative to the latter. The linear actuator 577 is connected to a controller and/or user interface 590 mounted on the front stanchion 516. Those skilled in the art will recognize that the linear actuator could be replaced by other suitable mechanisms, including a manually operated lead screw, for example.

The guide includes crank arms 570 which are 180 degrees out of phase, rotatably mounted to the frame member 517, and engaged with respective rear rocker arms 560. A post on each crank arm 570 passes through a slot 567 extending along an intermediate portion of a respective rear rocker link 560. As a result of this arrangement, rotation of the crank arms 570 is linked to pivoting of the rear rocker links 560. When the guide is moved upward along the rear stanchion 518, the rear rocker links 560 pivot through a relatively greater range of motion, and when the guide is moved downward, the rear rocker links 560 pivot through a relatively smaller range of motion.

A sprocket 578 is keyed to the same shaft as the crank arms 570 and rotates together therewith. The sprocket 578 is linked to the intermediate sprocket 558 on the flywheel shaft by means of a belt or chain 588 which is also routed about an idler in a tensioning assembly 580. The idler is movable in a horizontal direction along a frame member which is rigidly secured to the rear stanchion 518. A helical coil spring biases the idler rearward to maintain tension in the chain 588 regardless of the distance between the guide 570 and the flywheel axis.

On each side of the apparatus 500, a crank 550 is rotatably mounted on a lower end of a respective rear rocker link 560. A separate sprocket 556 is keyed to each crank 550 and connected to a respective sprocket 558 by means of a belt or chain 568. The common shaft extending between the sprockets 558 links rotation of the left crank 550 to rotation of the right crank 550.

On each side of the apparatus 500, a force receiving link 540 has a rear end rotatably connected to a respective crank 550 at a location radially displaced from the crank axis (defined between the crank 550 and the rear rocker link 560). A forward end of each force receiving link 540 is constrained to move in reciprocal fashion relative to the frame 510. An intermediate portion 544 of each force receiving link 540 is sized and configured to support a person's foot.

Each crank 550 cooperates with a respective rear rocker link 560 to define a crank and rocker combination which is connected, in series, between the frame 510 and a respective force receiving member 540. This portion of the linage assembly may also be described in terms of a first member (rear rocker link 560) which is mounted on the frame 510 and rotatable thereto about a first axis; a second member (crank 550) which is mounted on the first member and rotatable thereto about a second axis spaced radially apart from the first axis; and a force receiving member 540 which is mounted on the second member and rotatable thereto about a third axis spaced radially apart from the second axis (and the first axis).

On each side of the apparatus 500, the forward end of a force receiving member 540 is rotatably mounted on a lower end of a respective forward rocker link 530. An intermediate portion of each forward rocker link 530 is rotatably mounted to the forward stanchion 516. An upper end 533 of each forward rocker link 530 is sized and configured for grasping by a person standing on the foot supporting links 540. Those skilled in the art will recognize that the pivot axis of the forward rocker links 530 may be made adjustable along the length of the forward stanchion 516 in order to facilitate inclination adjustment to the paths of motion traversed by the foot supporting members 544.

Figure 12:
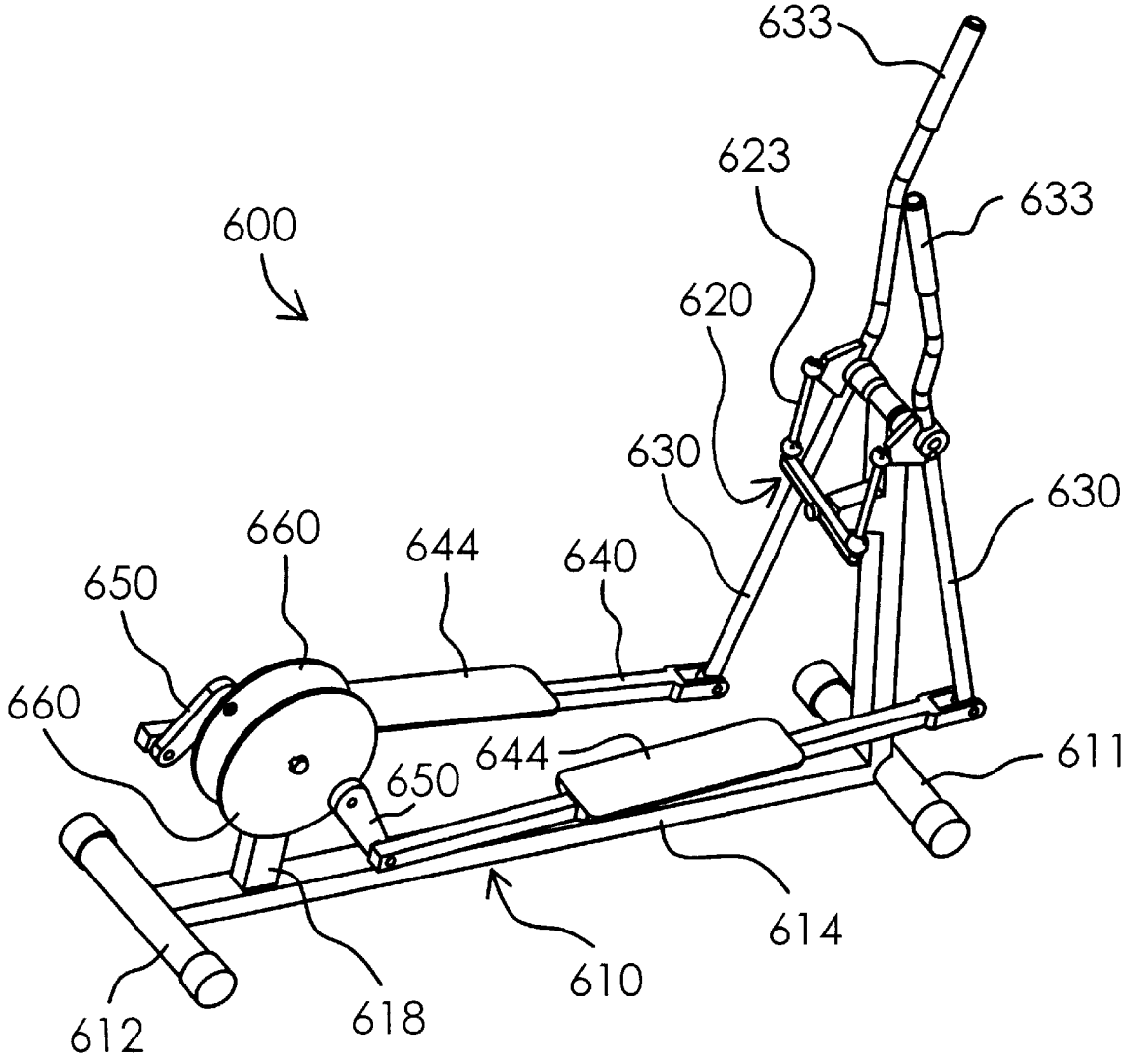
FIG. 12 is a side view of a sixth embodiment of the present invention.

A sixth exercise apparatus constructed according to the principles of the present invention is designated as 600 in FIG. 12. The apparatus 600 generally includes a frame 610 and a linkage assembly movably mounted on the frame 610. Generally speaking, the linkage assembly encourages a force receiving member 640 to travel through an elliptical path of motion having a selectively variable length.

The frame 610 includes a generally I-shaped base 614 designed to rest upon a floor surface; a forward stanchion 616, which extends upward from the base 614 proximate a forward end 611 of the frame 610; and a rearward stanchion 618, which extends upward from the base 614 proximate an opposite, rearward end 612 of the frame 610. The apparatus 600 is generally symmetrical about a vertical plane extending lengthwise through the base 614 (perpendicular to the transverse members at each end thereof), the only exceptions being the relative orientation of linkage assembly components on opposite sides of the plane of symmetry.

On each side of the apparatus 600, the linkage assembly generally includes a forward rocker link 630, a force receiving link 640, a rear rocker link 650, and a crank 660. On the embodiment 600, the crank 660 on the left side of the apparatus 600 is 180 degrees out of phase with the crank 660 on the right side of the apparatus 600, and the links on the left side move in opposite directions relative to their right side counterparts. However, like reference numerals are used to designate both the "right-hand" and "left-hand" parts on the apparatus 600, and in general, when reference is made to one or more parts on only one side of the apparatus, it is to be understood that corresponding part(s) are disposed on the opposite side of the apparatus 600.

On each side of the apparatus 600, a crank 660 is keyed to a common shaft rotatably mounted on the rear stanchion 618 by means known in the art. In this embodiment 600, the cranks 660 are flywheels with radially displaced pins secured thereto. A conventional drag strap or other known resistance device may be connected to one or both of the flywheels 660 to resist rotation. A separate rocker link 650 is rotatably connected to each crank 660 and may be biased (by means not shown) to occupy a particular position and/or resist movement in a particular direction.

On each side of the apparatus 600, a force receiving link 640 has a rear end rotatably connected to a respective rocker link 650 at a location radially displaced from the rocker axis (defined between the crank 660 and the rear rocker link 650). A forward end of each force receiving link 640 is constrained to move in reciprocal fashion relative to the frame 610. An intermediate portion 644 of each force receiving link 640 is sized and configured to support a person's foot.

Each rocker link 650 cooperates with a respective crank 660 to define a crank and rocker combination which is connected, in series, between the frame 610 and a respective force receiving member 640. This portion of the linage assembly may also be described in terms of a first member (crank 660) which is mounted on the frame 610 and rotatable thereto about a first axis; a second member (rocker link 650) which is mounted on the first member and rotatable thereto about a second axis spaced radially apart from the first axis; and a force receiving member 640 which is mounted on the second member and rotatable thereto about a third axis spaced radially apart from the second axis (and the first axis).

On each side of the apparatus 600, the forward end of a force receiving member 640 is rotatably mounted on a lower end of a respective forward rocker link 630. An intermediate portion of each forward rocker link 630 is rotatably mounted to the forward stanchion 616. An upper end 633 of each forward rocker link 630 is sized and configured for grasping by a person standing on the foot supporting links 640.

The forward rocker links 630 are interconnected to move in dependent fashion in opposite directions relative to one another. In particular, a connector link 620 is mounted on the forward stanchion 416 and rotatable relative thereto about a horizontal axis. A second, relatively lower intermediate portion of each forward rocker link 630 is connected to the connector link 620 by means of an intermediate link 623, which is movably fastened to both the connector link 620 and a respective forward rocker link 630.

Figure 13:
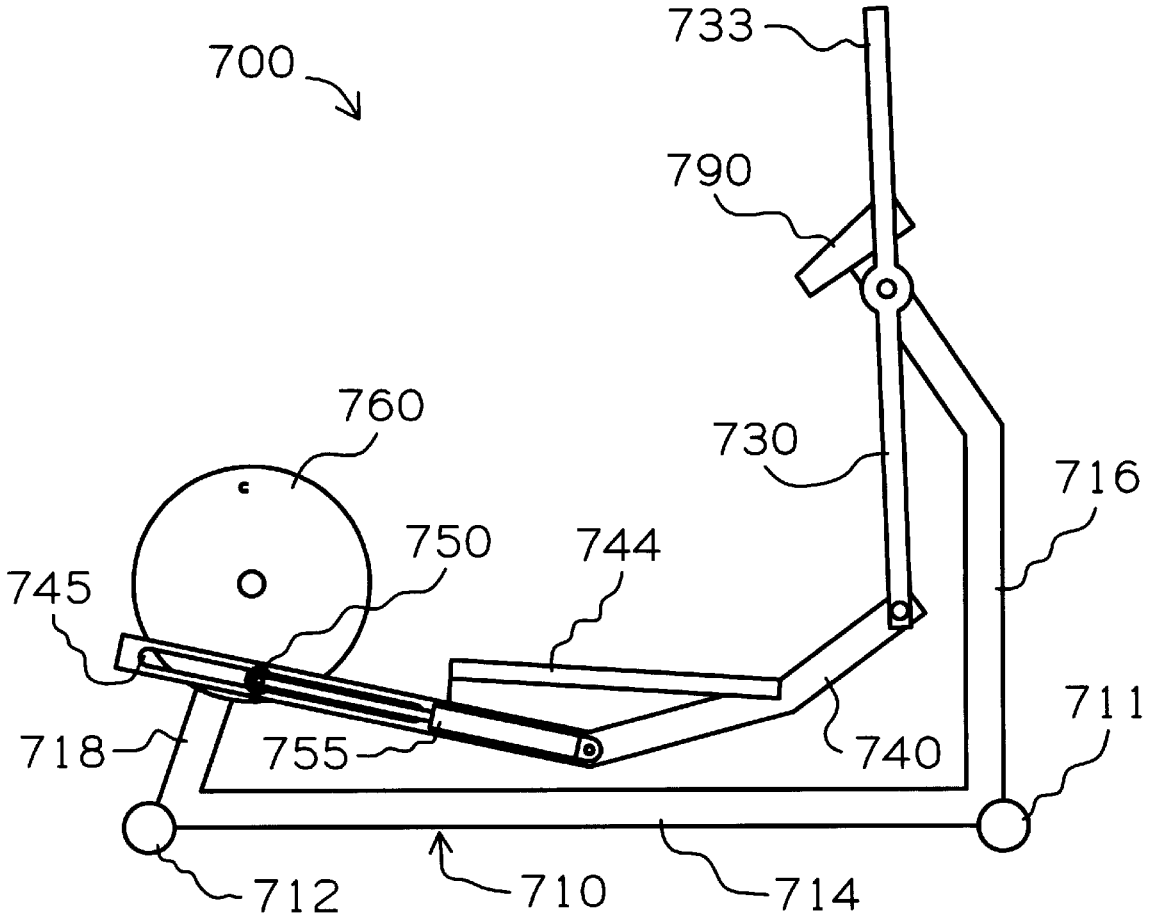
FIG. 13 is a side view of a seventh embodiment of the present invention.

A seventh exercise apparatus constructed according to the principles of the present invention is designated as 700 in FIG. 13. The apparatus 700 generally includes a frame 710 and a linkage assembly movably mounted on the frame 710. Generally speaking, the linkage assembly encourages a force receiving member 740 to travel through an elliptical path of motion having a selectively variable length.

The frame 710 includes a generally I-shaped base 714 designed to rest upon a floor surface; a forward stanchion 716, which extends upward from the base 714 proximate a forward end 711 of the frame 710; and a rearward stanchion 718, which extends upward from the base 714 proximate an opposite, rearward end 712 of the frame 710. The apparatus 700 is generally symmetrical about a vertical plane extending lengthwise through the base 714 (perpendicular to the transverse members at each end thereof), the only exceptions being the relative orientation of linkage assembly components on opposite sides of the plane of symmetry.

On each side of the apparatus 700, the linkage assembly generally includes a forward rocker link 730, a force receiving link 740, a crank 760, and a roller 750 interconnected between the force receiving link 740 and the crank 760. On the embodiment 700, the crank 760 on the left side of the apparatus 700 is 180 degrees out of phase with the crank 760 on the right side of the apparatus 700, and the links on the left side move in opposite directions relative to their right side counterparts. However, like reference numerals are used to designate both the "right-hand" and "left-hand" parts on the apparatus 700, and in general, when reference is made to one or more parts on only one side of the apparatus, it is to be understood that corresponding part(s) are disposed on the opposite side of the apparatus 700.

On each side of the apparatus 700, a crank 760 is keyed to a common shaft which is rotatably mounted on the rear stanchion 718 by means known in the art. In this embodiment 700, the cranks 760 are flywheels with radially displaced pins secured thereto. A conventional drag strap or other known resistance device may be connected to one or both of the flywheels 760 to provide resistance to rotation. A separate roller 750 is rotatably connected to each crank 760 and projects axially away from the crank 760.

On each side of the apparatus 700, a force receiving link 740 has a rear end supported by a respective roller 750. In particular, the roller 750 projects into an elongate slot 745 formed in the force receiving link 740. A damper 755 is interconnected between the roller 750 and an intermediate portion of the force receiving member 740 to dampen relative movement therebetween. In the embodiment 700, the damper 755 operates in only one direction, to resist rearward movement of the force receiving member 740. A separate foot supporting platform 744 is also connected to the intermediate portion of each force receiving member 740. A forward end of each force receiving link 740 is constrained to move in reciprocal fashion relative to the frame 710.

Each roller 750 cooperates with a respective crank 760 to introduce rotational movement and a degree of freedom, in series, between the frame 710 and a respective force receiving member 740. This portion of the linage assembly may also be described in terms of means for determining displacement of the force receiving members in a first direction (and in cyclical fashion), and means for allowing the user to determine displacement of the force receiving members in a second, perpendicular direction.

On each side of the apparatus 700, the forward end of a force receiving member 740 is rotatably mounted on a lower end of a respective forward rocker link 730. An intermediate portion of each forward rocker link 730 is rotatably mounted to the forward stanchion 716. An upper end 733 of each forward rocker link 730 is sized and configured for grasping by a person standing on the foot supporting links 740. Like on certain previous embodiments, the forward rocker links 730 are preferably interconnected to move in dependent fashion in opposite directions relative to one another.

Those skilled in the art will recognize additional embodiments, modifications, and/or applications which differ from those described herein yet nonetheless fall within the scope of the present invention. For example, force receiving members similar to those on the apparatus 700 could be rotatably connected directly to cranks, which in turn, could be slidably mounted on a frame. Dampers and/or springs may be interconnected between the crank shaft and the frame to control and/or limit movement of the former relative to the latter. Moreover, a variety of linear or rotary dampers, actuators, servo motors, clutches, and/or other known devices may be incorporated into one or more of the disclosed embodiments to alter the "feel" of the apparatus. Furthermore, the size, configuration, and/or arrangement of the components of the disclosed embodiments may be modified as a matter of design choice. Recognizing that the foregoing description sets forth only some of the numerous possible modifications and variations, the scope of the present invention is to be limited only to the extent of the claims which follow.

What is claimed is:

1. An exercise apparatus, comprising:

a frame designed to rest upon a floor surface;

first and second force receiving members, each sized and configured to accommodate a person's foot;

first and second cranks; and first and second rocker links rotatably connected to respective cranks, wherein one of the first crank and the first rocker link is connected to the frame and moves about an axis relative thereto, and the other of the first crank and the first rocker link is connected to the first force receiving member and moves about an axis relative thereto, and one of the second crank and the second rocker link is connected to the frame and moves about an axis relative thereto, and the other of the second crank and the second rocker link is connected to the second force receiving member and moves about an axis relative thereto.

2. The exercise apparatus of claim 1, wherein the first rocker link is interconnected between the first crank and the frame, and the second rocker link is interconnected between the second crank and the frame.

3. The exercise apparatus of claim 2, wherein the first and second force receiving members are pedals.

4. The exercise apparatus of claim 1, wherein the first and second force receiving members are rotatably mounted to respective cranks.

5. The exercise apparatus of claim 1, wherein the first and second force receiving members are pedals.

6. The exercise apparatus of claim 1, wherein the first and second cranks are synchronized.

7. The exercise apparatus of claim 1, wherein each of the rocker links is biased against movement in at least one direction.

8. An exercise apparatus, comprising:

first and second cranks;

first and second rocker links rotatably connected to respective cranks to form respective first and second crank and rocker link combinations;

a frame designed to rest upon a floor surface; and first and second force receiving members, each sized and configured to accommodate a person's foot, wherein the first crank and rocker link combination is movably interconnected between the first force receiving member and the frame, and the second crank and rocker link combination is movably interconnected between the second force receiving member and the frame.

9. The exercise apparatus of claim 8, wherein the first rocker link is interconnected between the first crank and the frame, and the second rocker link is interconnected between the second crank and the frame.

10. The exercise apparatus of claim 9, wherein the first and second force receiving members are pedals.

11. The exercise apparatus of claim 8, wherein the first and second force receiving members are rotatably mounted to respective cranks.

12. The exercise apparatus of claim 8, wherein the first and second force receiving members are pedals.

13. The exercise apparatus of claim 8, wherein the first and second cranks are synchronized.

14. The exercise apparatus of claim 8, wherein each of the rocker links is biased against movement in at least one direction.

15. An elliptical motion exercise apparatus, comprising:

a frame designed to rest upon a floor surface;

first and second force receiving members, each sized and configured to accommodate a person's foot;

first and second crank assemblies interconnected between the frame and respective first and second force receiving members, wherein each of the assemblies includes (a) a crank which rotates about a crank axis and has a connection point disposed at a radial distance from the crank axis; and (b) a means for (i) limiting displacement of the force receiving members in a first direction to twice the radial distance, and (ii) allowing relatively greater displacement of the force receiving members in a second, perpendicular direction in response to user exerted force applied to the force receiving members, whereby the force receiving members are movable through respective closed loops which vary in configuration according to the user exerted force.

16. The exercise apparatus of claim 15, wherein each said means includes a rocker link, and each of the cranks is rotatably mounted on a respective rocker link, and each rocker link is pivotally mounted on the frame.

17. The exercise apparatus of claim 16, wherein each rocker link is biased to resist movement in at least one direction.

18. The exercise apparatus of claim 15, further comprising a means for resisting displacement of the force receiving members in the second, perpendicular direction.

* * * * *